US012251059B2

(12) United States Patent
Neumann

(10) Patent No.: US 12,251,059 B2
(45) Date of Patent: Mar. 18, 2025

(54) MOBILE CLEANING ROBOT SUSPENSION

(71) Applicant: iRobot Corporation, Bedford, MA (US)

(72) Inventor: Rogelio Manfred Neumann, Somerville, MA (US)

(73) Assignee: iRobot Corporation, Bedford, MA (US)

( * ) Notice: Subject to any disclaimer, the term of this patent is extended or adjusted under 35 U.S.C. 154(b) by 309 days.

(21) Appl. No.: 17/878,953

(22) Filed: Aug. 2, 2022

(65) Prior Publication Data

US 2024/0041285 A1 Feb. 8, 2024

(51) Int. Cl.

| | |
|---|---|
| ***A47L 11/40*** | (2006.01) |
| ***A47L 11/24*** | (2006.01) |
| *A47L 11/28* | (2006.01) |

(52) U.S. Cl.

CPC ..... *A47L 11/24* (2013.01); *A47L 11/4063* (2013.01); *A47L 11/28* (2013.01); *A47L 11/4088* (2013.01); *A47L 2201/00* (2013.01)

(58) Field of Classification Search

CPC .. A47L 11/24; A47L 11/40; A47L 9/04; A47L 11/28; A47L 11/4088

See application file for complete search history.

(56) References Cited

U.S. PATENT DOCUMENTS 7,761,954 B2 * 7/2010 Ziegler ..... A47L 11/4061 15/340.1
2008/0065265 A1 * 3/2008 Ozick ..... G05D 1/0227 901/1
2008/0281470 A1 * 11/2008 Gilbert, Jr. ..... B60L 15/2036 901/1
2013/0298350 A1 11/2013 Schnittman et al.
2014/0182627 A1 * 7/2014 Williams ..... A47L 11/4088 134/21
2014/0215735 A1 * 8/2014 Gilbert, Jr. ..... A47L 11/302 15/98

(Continued)

FOREIGN PATENT DOCUMENTS

| | | |
|---|---|---|
| EP | 2659989 | 11/2013 |
| EP | 2148604 | 6/2014 |

(Continued)

OTHER PUBLICATIONS

"International Application Serial No. PCT US2023 028601, International Search Report mailed Dec. 8, 2023", 5 pgs.

(Continued)

*Primary Examiner* — Michael D Jennings

(74) *Attorney, Agent, or Firm* — Schwegman Lundberg & Woessner, P.A.

(57) ABSTRACT

A mobile cleaning robot movable within an environment can include a body, a drive arm, a container, a biasing element, and a link. The drive arm can be connected to the body and can be movable with respect to the body. The drive arm can support a drive wheel. The container can be connectable to the body and can be configured to carry a fluid therein. The biasing element can be connected to the drive arm to bias the drive wheel toward a floor surface. The link can be pivotably connected to the body and can be connected to the biasing element. The link can be engageable with the tank to adjust the biasing element based on an amount of the fluid in the container.

20 Claims, 9 Drawing Sheets

(56) References Cited

U.S. PATENT DOCUMENTS

| | | | | |
|---|---|---|---|---|
| 2019/0059680 | A1* | 2/2019 | Fox | A47L 11/4011 |
| 2019/0210409 | A1* | 7/2019 | Grace | A47L 11/28 |
| 2020/0337513 | A1 | 10/2020 | Johnson et al. | |
| 2022/0304543 | A1* | 9/2022 | Du | A47L 11/408 |

FOREIGN PATENT DOCUMENTS

| | | | | |
|---|---|---|---|---|
| KR | 20080028220 | | 3/2008 | |
| WO | WO-2021187723 | A1 * | 9/2021 | A47L 11/28 |

OTHER PUBLICATIONS

"International Application Serial No. PCT US2023 028601, Written Opinion mailed Dec. 8, 2023", 6 pgs.

* cited by examiner

MOBILE CLEANING ROBOT SUSPENSION

BACKGROUND

Mobile robots include mobile cleaning robots that can perform cleaning tasks within an environment, such as a home. A mobile cleaning robot can navigate across a floor surface and avoid obstacles while spraying fluid or applying fluid via a pad. The fluid can then be absorbed by a pad to effectively perform mopping operations within the environment as the robot traverses the environment.

SUMMARY

Mobile cleaning robots can autonomously navigate through environments to perform cleaning operations, often traversing over, and navigating around, obstacles. Mobile cleaning robots include suspension systems to provide sufficient wheel downforce to overcome obstacles and to provide effective cleaning on various surfaces. Because obstacles can vary in shape and size and because floor types can also vary, a required wheel downforce can vary during operation of the robot. Many robots include suspension systems using an extension or compression spring directly connected to wheel arms, which can effectively deliver downforce; however, in mopping robots, the mass or weight of the robot can vary throughout a mission, altering the preferred delivered downforce for optimal cleaning performance.

This disclosure describes devices and methods that can help to address this problem such as by including a suspension system including a container for storing cleaning fluid that is connected to one or more links and a biasing element connected to a drive arm of the wheel. As the fluid level in the tank changes, the weight or mass of the tank (and the robot) will change affecting the desired downforce for optimal cleaning performance and mobility. The tank can be movable as the volume of fluid changes to move the link, which can, in turn, move the extension spring to adjust a downforce provided to the drive arm and the drive wheel (or wheels) of the robot. In this way, the robot can include a passive suspension adjustment system to help adjust the delivered downforce based on an amount of fluid (and mass of fluid) within the tank to improve cleaning performance and mobility as the amount of fluid in the tank varies over the course of a cleaning mission.

For example, a mobile cleaning robot movable within an environment can include a body, a drive arm, a container, a biasing element, and a link. The drive arm can be connected to the body and can be movable with respect to the body. The drive arm can support a drive wheel. The container can be connectable to the body and can be configured to carry a fluid therein. The biasing element can be connected to the drive arm to bias the drive wheel toward a floor surface. The link can be pivotably connected to the body and can be connected to the biasing element. The link can be engageable with the tank to adjust the biasing element based on an amount of the fluid in the container.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Robot Overview

Figure 1:
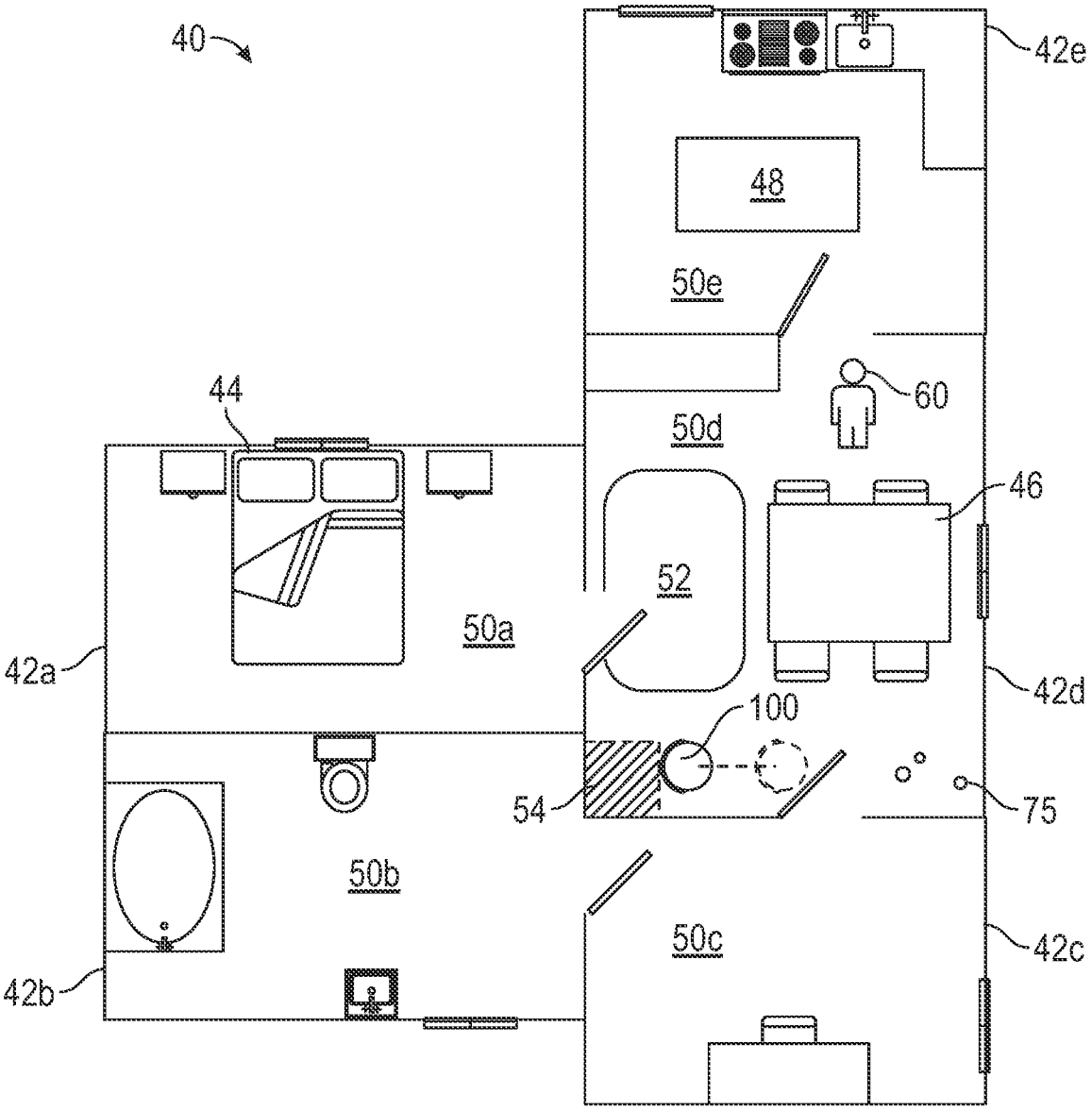
FIG. 1 illustrates a plan view of a mobile cleaning robot in an environment.

FIG. 1 illustrates a plan view of a mobile cleaning robot 100 in an environment 40. The environment 40 can be a dwelling, such as a home or an apartment, and can include rooms 42*a*-42*e*. Obstacles, such as a bed 44, a table 46, and an island 48 can be located in the rooms 42 of the environment. Each of the rooms 42*a*-42*e* can have a floor surface 50*a*-50*e*, respectively. Some rooms, such as the room 42*d*, can include a rug, such as a rug 52. The floor surfaces 50 can be of one or more types such as hardwood, ceramic, low-pile carpet, medium-pile carpet, long (or high)-pile carpet, stone, or the like.

The mobile cleaning robot 100 can be operated, such as by a user 60, to autonomously clean the environment 40 in a room-by-room fashion. In some examples, the robot 100 can clean the floor surface 50*a* of one room, such as the room 42*a*, before moving to the next room, such as the room 42*d*, to clean the surface of the room 42*d*. Different rooms can have different types of floor surfaces. For example, the room 42*e* (which can be a kitchen) can have a hard floor surface, such as wood or ceramic tile, and the room 42*a* (which can be a bedroom) can have a carpet surface, such as a medium pile carpet. Other rooms, such as the room 42*d* (which can be a dining room) can include multiple surfaces where the rug 52 is located within the room 42*d*. The robot 100 can be configured to navigate over various floor types through one or more components such as a suspension. The suspension of the robot can allow the robot 100 to navigate over obstacles, such as thresholds between rooms or over rugs, such as the rug 52.

Also, during cleaning or traveling operations, the robot 100 can use data collected from various sensors (such as optical sensors) and calculations (such as odometry and obstacle detection) to develop a map of the environment 40. Once the map is created, the user 60 can define rooms or zones (such as the rooms 42) within the map. The map can be presentable to the user 60 on a user interface, such as a mobile device, where the user 60 can direct or change cleaning preferences, for example.

Also, during operation, the robot 100 can detect surface types within each of the rooms 42, which can be stored in the robot or another device. The robot 100 can update the map (or data related thereto) such as to include or account for surface types of the floor surfaces 50*a*-50*e* of each of the respective rooms 42 of the environment. In some examples, the map can be updated to show the different surface types such as within each of the rooms 42.

Components of the Robot

Figure 2A:
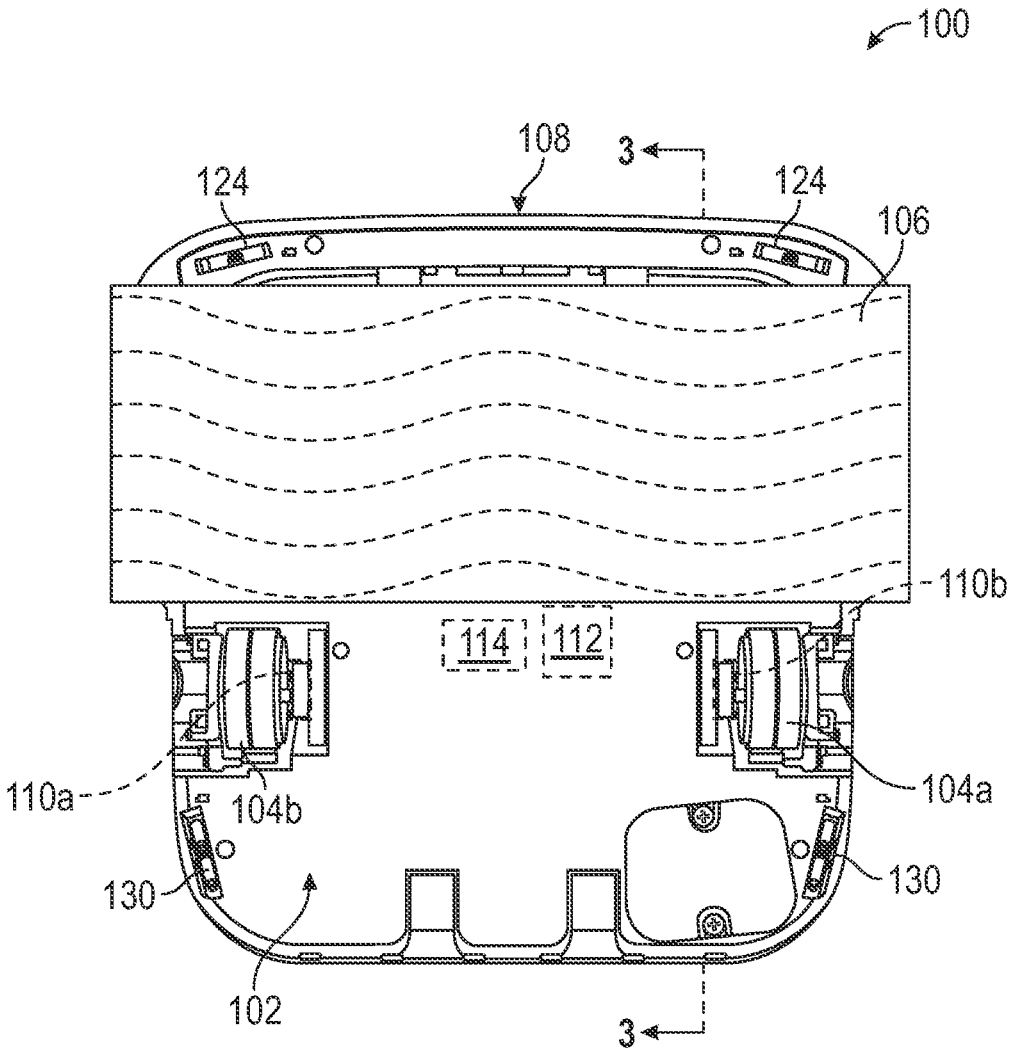
FIG. 2A illustrates a bottom view of a mobile cleaning robot.
Figure 2B:
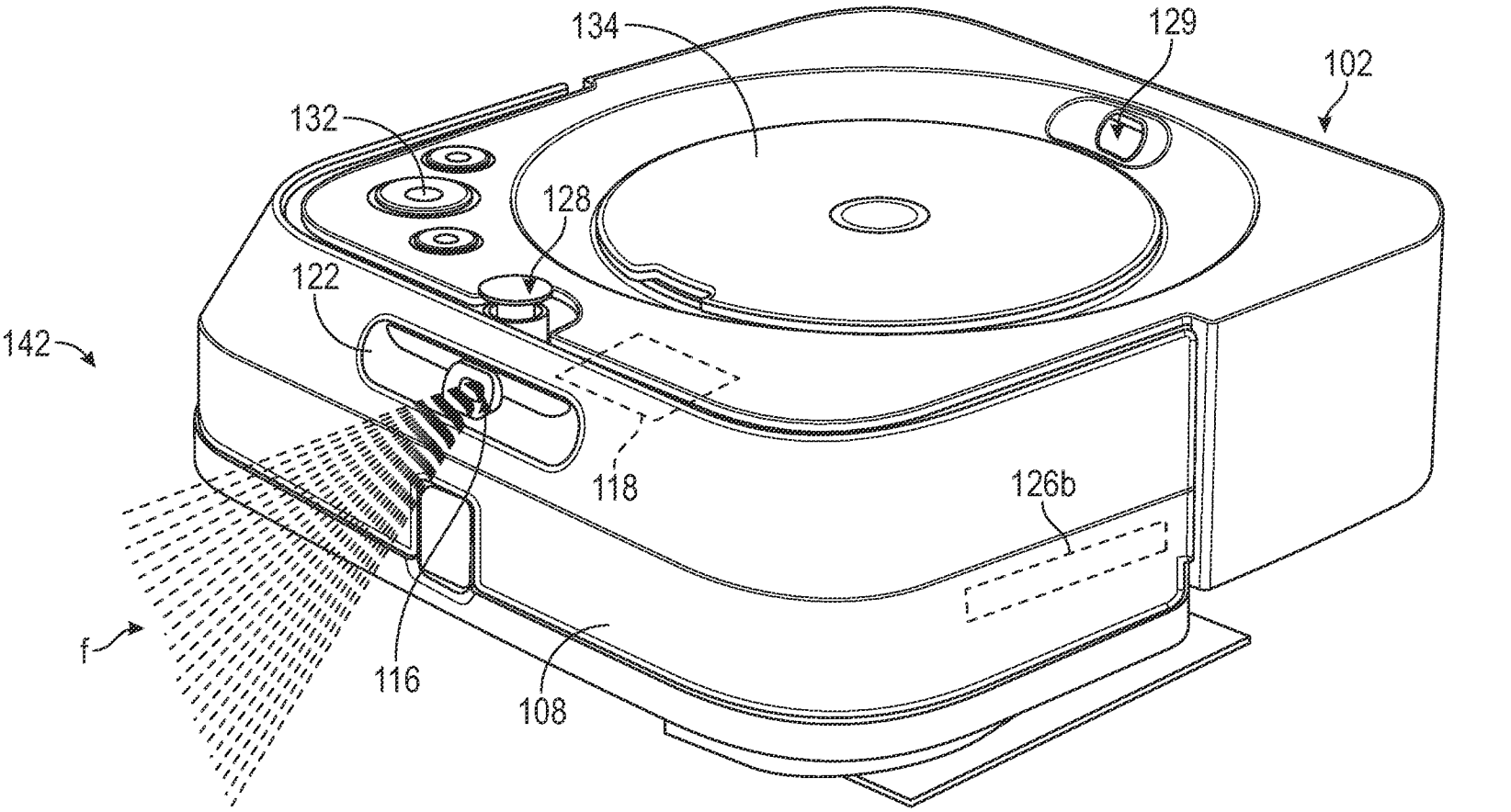
FIG. 2B illustrates an isometric view of a mobile cleaning robot.
Figure 2C:
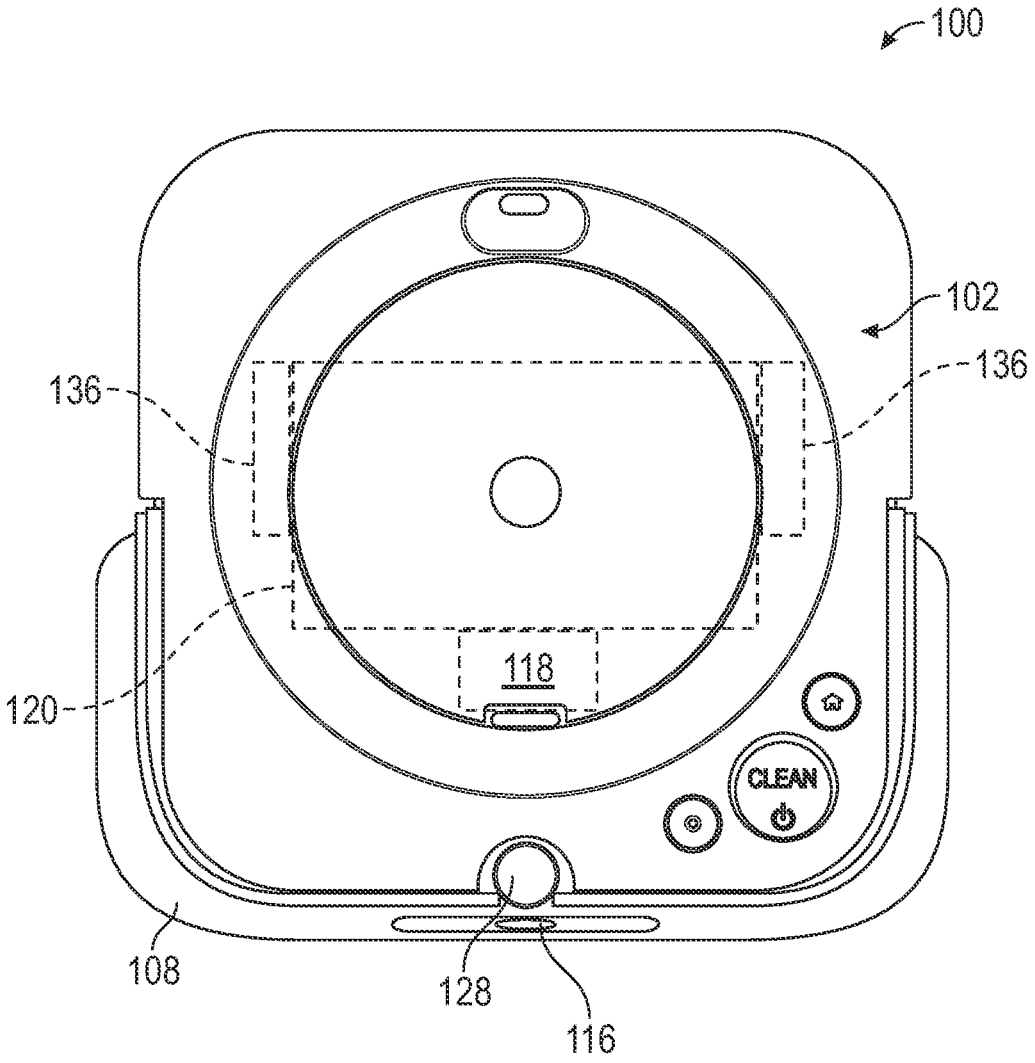
FIG. 2C illustrates a top view of a mobile cleaning robot.

FIG. 2A illustrates a bottom view of the mobile cleaning robot 100. FIG. 2B illustrates a bottom view of the mobile cleaning robot 100. FIG. 2C illustrates a top view of the mobile cleaning robot 100. FIGS. 2A-2C are discussed together below.

The cleaning robot 100 can be a mobile cleaning robot that can autonomously traverse the floor surface 50 while mopping up dirt or debris 75 from different parts of the floor surface 50. As depicted in FIGS. 2A-2C, the robot 100 can include a body 102 movable across the floor surface 50. The body 102 can include multiple connected structures to which movable components of the cleaning robot 100 can be mounted. The connected structures can include an outer housing 103 to cover internal components of the cleaning robot 100, a chassis to which drive wheels 104*a* and 104*b*, a cleaning pad 106 are mounted, and a bumper 108 mounted to the outer housing.

As shown in FIG. 2A, the robot 100 can include a drive system including actuators 110*a* and 110*b*, e.g., motors, operable with drive wheels 104*a* and 104*b*. The actuators 110*a* and 110*b* can be mounted in the body 102 and can be operably connected to the drive wheels 104*a* and 104*b*, which are rotatably mounted to the body 102. The drive wheels 104*a* and 104*b* can support the body 102 above the floor surface 50. The actuators 110*a* and 110*b*, when driven, can rotate the drive wheels 104*a* and 104*b* to enable the robot 100 to move across the floor surface 50.

The controller (or processor) 112 can be located within the housing 103 and can be a programmable controller, such as a single or multi-board computer, a direct digital controller (DDC), a programmable logic controller (PLC), or the like. In other examples the controller 112 can be any computing device, such as a handheld computer, for example, a smart phone, a tablet, a laptop, a desktop computer, or any other computing device including a processor and communication capabilities. Memory 114 can be one or more types of memory, such as volatile or non-volatile memory, read-only memory (ROM), random-access memory (RAM), magnetic disk storage media, optical storage media, flash-memory devices, and other storage devices and media. The memory 114 can be located within the housing 103 and can be connected to the controller 112 and accessible by the controller 112.

As shown in FIG. 2B, the robot 100 can also include a nozzle or ejection port 116 configured to spray or discharge fluid f from the robot and onto the floor surface 50. The nozzle or ejection port 116 can be connected to a pump 118 located within the body 102 or housing 103. The nozzle or ejection port 116 can be connected to the pump 118 via tubing or piping. The robot 100 can also include, as shown in FIG. 2C, a tank or container 120 configured to store the fluid f within the body 102 or housing 103 during a cleaning mission. The pump 118 can be connected to the tank 120 via tubing or piping to connect the nozzle or ejection port 116 to the tank 120. The pump 118 can also be connected to the controller 112.

The controller 112 can operate the actuators 110*a* and 110*b* to autonomously navigate the robot 100 about the floor surface 50 during a cleaning operation. The actuators 110*a* and 110*b* are operable to drive the robot 100 in a forward drive direction, in a backwards direction, and to turn the robot 100. The cleaning pad 106 can help to support a front portion of the body 102 above the floor surface 50, and the drive wheels 104*a* and 104*b* support a middle and rear portion of the body 102 above the floor surface 50. The cleaning pad 106 can be removably mounted to the body 102 of the robot 100. In this way, the cleaning pad 106 can be user replaceable such as when the cleaning pad 106 becomes dirty during a cleaning mission.

The control system can further include a sensor system 122 including one or more electrical or optical sensors. The sensor system, as described herein, can include one or more sensor to generate a signal indicative of a current location of the robot 100, and can include sensors to generate signals indicative of locations of the robot 100 as the robot 100 travels along the floor surface 50.

Cliff sensors 124 (shown in FIG. 2A) can be located along a bottom portion of the housing 103. Each of the cliff sensors 124 can be an optical sensor that can be configured to detect a presence or absence of an object below the optical sensor, such as the floor surface 50. The cliff sensors 124 can be connected to the controller 112. The bumper 108 can be removably secured to the body 102 and can be movable relative to body 102 while mounted thereto. In some examples, the bumper 108 form part of the body 102. Bump sensors 126*a* and 126*b* (the bump sensors 126) can be connected to the body 102 and engageable or configured to interact with the bumper 108. The bump sensors 126 can include break beam sensors, capacitive sensors, switches, or other sensors that can detect contact between the robot 100, i.e., the bumper 108, and objects in the environment 40. The bump sensors 126 can be in communication with the controller 112.

An image capture device 128 can be a LIDAR sensor connected to the body 102 and can extend through the bumper 108 of the robot 100, such as through an opening of the bumper 108. The image capture device 128 can be configured to generate a signal based on imagery of the environment 40 of the robot 100 as the robot 100 moves about the floor surface 50. The image capture device 128 can transmit the signal to the controller 112 for use for navigation and cleaning routines. An image capture device 129 can be a camera connected to the body 102 and can extend through the bumper 108 of the robot 100. The image capture device 129 can be a camera, such as a front-facing camera, configured to generate a signal based on imagery of the environment 40 of the robot 100 as the robot 100 moves about the floor surface 50. The image capture device 129 can transmit the signal to the controller 112 for use for navigation and cleaning routines.

Obstacle following sensors 130 (shown in FIG. 2A) can include an optical sensor facing outward from the bumper 108 and that can be configured to detect the presence or the absence of an object adjacent to a side of the body 102. The obstacle following sensor 130 can emit an optical beam horizontally in a direction perpendicular (or nearly perpendicular) to the forward drive direction of the robot 100. The optical emitter can emit an optical beam outward from the robot 100, e.g., outward in a horizontal direction, and the optical detector detects a reflection of the optical beam that reflects off an object near the robot 100. The robot 100, e.g., using the controller 112, can determine a time of flight of the optical beam and thereby determine a distance between the optical detector and the object, and hence a distance between the robot 100 and the object.

The robot 100 can also include one or more buttons 132 (or interfaces) that can include a user-operable interface configured to provide commands to the robot, such as to pause a mission, power on, power off, or return to a docking station.

As shown in FIG. 2B, a lid 134 can be connected to the body 102, such as over the tank 120. The lid 134 can be operable to open to access the tank 120 such as for insertion or removal of the tank 120 or for addition of the fluid f (e.g., cleaning fluid) to the tank 120. FIG. 2B also shows that links 136 can be connected to one or more lateral sides of the tank 120. The 136 can be part of the suspension system as discussed in further detail below.

Operation of the Robot

In operation of some examples, the robot 100 can be propelled in a forward drive direction or a rearward drive direction. The robot 100 can also be propelled such that the robot 100 turns in place or turns while moving in the forward drive direction or the rearward drive direction.

When the controller 112 causes the robot 100 to perform a mission, the controller 112 can operate the motors 110 to drive the drive wheels 104 and propel the robot 100 along the floor surface 50. In addition, the controller 112 can operate the pump 118 to dispense fluid f on the floor surface 50. The controller 112 can execute software stored on the memory 114 to cause the robot 100 to perform various navigational and cleaning behaviors by operating the various motors of the robot 100.

The various sensors of the robot 100 can be used to help the robot navigate and clean within the environment 40. For example, the cliff sensors 124 can detect obstacles such as drop-offs and cliffs below portions of the robot 100 where the cliff sensors 124 are disposed. The cliff sensors 124 can transmit signals to the controller 112 so that the controller 112 can redirect the robot 100 based on signals from the cliff sensors 124.

In some examples, the bump sensor 126*a* can be used to detect movement of the bumper 108 along a fore-aft axis of the robot 100. A bump sensor 126*b* can also be used to detect movement of the bumper 108 along one or more sides of the robot 100. The bump sensors 126 can transmit signals to the controller 112 so that the controller 112 can redirect the robot 100 based on signals from the bump sensors 126.

The image capture device 128 can be configured to generate a signal based on imagery of the environment 40 of the robot 100 as the robot 100 moves about the floor surface 50. The image capture device 128 can transmit such a signal to the controller 112. In some examples, obstacle following sensors 130 can detect detectable objects, including obstacles such as furniture, walls, persons, and other objects in the environment of the robot 100. In some implementations, the sensor system can include an obstacle following sensor along a side surface, and the obstacle following sensor can detect the presence or the absence an object adjacent to the side surface. The one or more obstacle following sensors 130 can also serve as obstacle detection sensors, similar to the proximity sensors described herein. The image capture device 129 can be angled in an upward direction, e.g., angled between 5 degrees and 45 degrees from the floor surface 50 about which the robot 100 navigates. The image capture device 129, when angled upward, can capture images of wall surfaces of the environment so that features corresponding to objects on the wall surfaces can be used for localization.

The robot 100 can also include sensors for tracking a distance travelled by the robot 100. For example, the sensor system can include encoders associated with the motors 110 for the drive wheels 104, and the encoders can track a distance that the robot 100 has travelled. In some implementations, the sensor can include an optical sensor facing downward toward a floor surface. The optical sensor can be positioned to direct light through a bottom surface of the robot 100 toward the floor surface 50. The optical sensor can detect reflections of the light and can detect a distance travelled by the robot 100 based on changes in floor features as the robot 100 travels along the floor surface 50.

The controller 112 can use data collected by the sensors of the sensor system to control navigational behaviors of the robot 100 during the mission. For example, the controller 112 can use the sensor data collected by obstacle detection sensors of the robot 100, (the cliff sensors 124, the bump sensors 126, and the image capture device 128) to enable the robot 100 to avoid obstacles within the environment of the robot 100 during the mission.

The sensor data can also be used by the controller 112 for simultaneous localization and mapping (SLAM) techniques in which the controller 112 extracts features of the environment represented by the sensor data and constructs a map of the floor surface 50 of the environment. The sensor data collected by the image capture device 128 can be used for techniques such as vision-based SLAM (VSLAM) in which the controller 112 extracts visual features corresponding to objects in the environment 40 and constructs the map using these visual features. As the controller 112 directs the robot 100 about the floor surface 50 during the mission, the controller 112 can use SLAM techniques to determine a location of the robot 100 within the map by detecting features represented in collected sensor data and comparing the features to previously stored features. The map formed from the sensor data can indicate locations of traversable and non-traversable space within the environment. For example, locations of obstacles can be indicated on the map as non-traversable space, and locations of open floor space can be indicated on the map as traversable space.

The sensor data collected by any of the sensors can be stored in the memory 114. In addition, other data generated for the SLAM techniques, including mapping data forming the map, can be stored in the memory 114. These data produced during the mission can include persistent data that are produced during the mission and that are usable during further missions. In addition to storing the software for causing the robot 100 to perform its behaviors, the memory 114 can store data resulting from processing of the sensor data for access by the controller 112. For example, the map can be a map that is usable and updateable by the controller 112 of the robot 100 from one mission to another mission to navigate the robot 100 about the floor surface 50.

The persistent data, including the persistent map, helps to enable the robot 100 to efficiently clean the floor surface 50. For example, the map enables the controller 112 to direct the robot 100 toward open floor space and to avoid non-traversable space. In addition, for subsequent missions, the controller 112 can use the map to optimize paths taken during the missions to help plan navigation of the robot 100 through the environment 40.

Suspension Examples

Figure 3A:
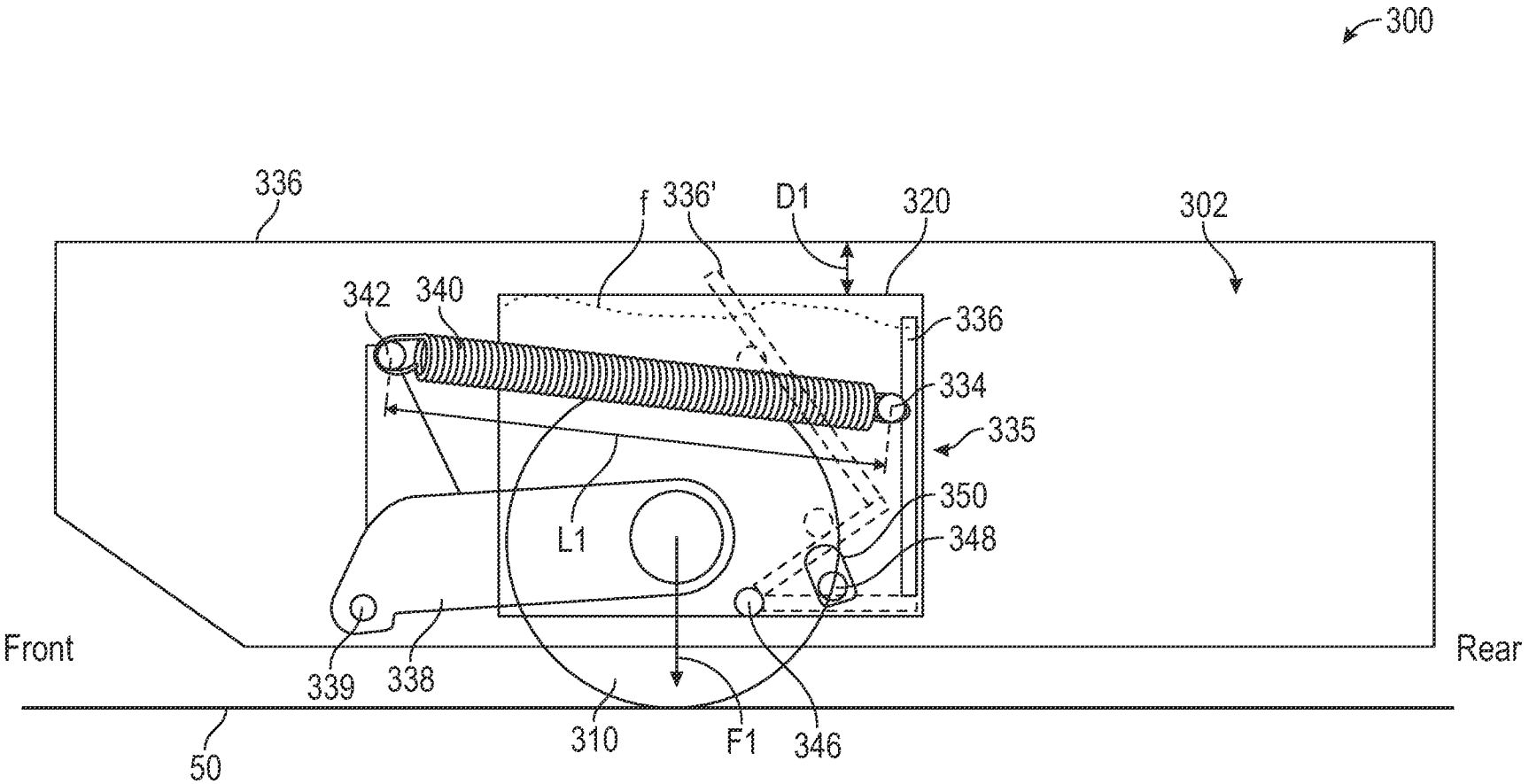
FIG. 3A illustrates a cross-section view of a mobile cleaning robot across indicators 3-3 of FIG. 2A in a first condition.
Figure 3B:
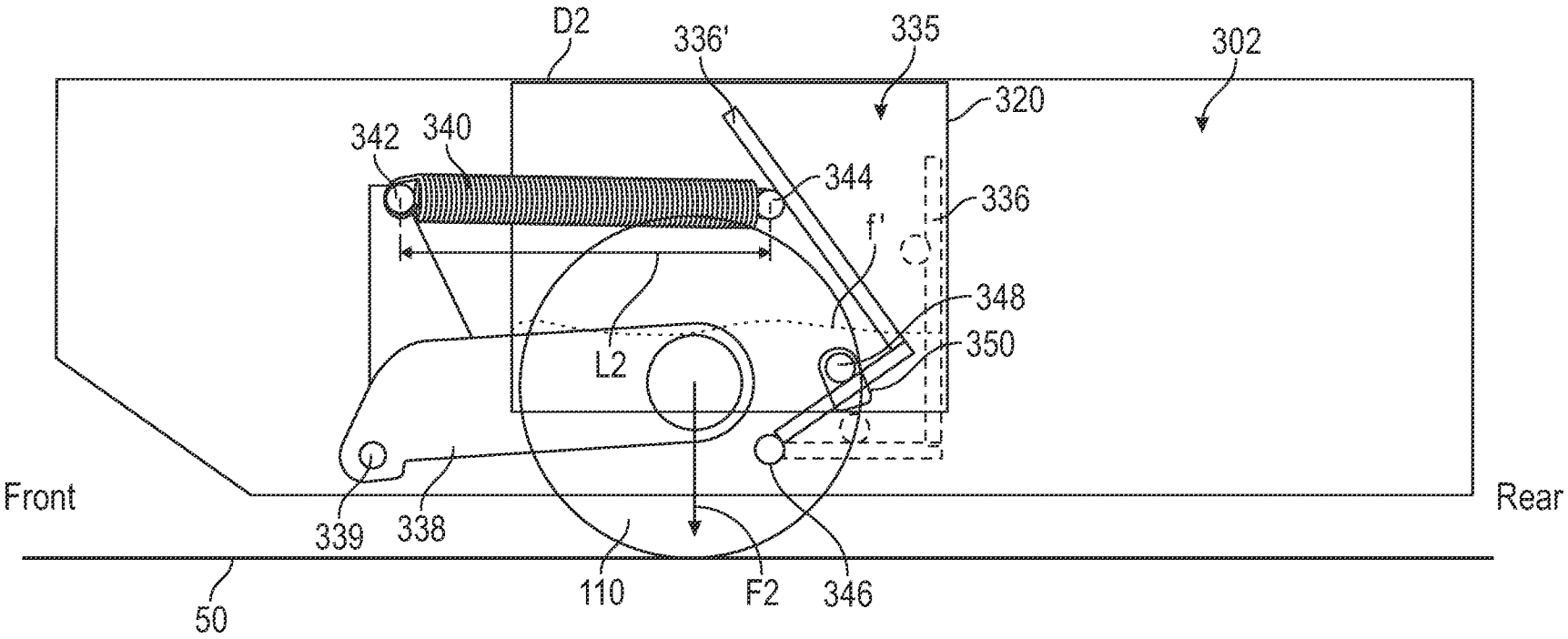
FIG. 3B illustrates a cross-section view of a mobile cleaning robot across indicators 3-3 of FIG. 2A in a second condition.

FIG. 3A illustrates a cross-section view of a mobile cleaning robot 300 across indicators 3-3 of FIG. 2A in a first condition. FIG. 3A illustrates a cross-section view of the mobile cleaning robot 300 across indicators 3-3 of FIG. 2A in a second condition. FIGS. 3A and 3B are discussed together below. The mobile cleaning robot 300 can be similar to the robot 100 discussed above; like numerals can represent similar components.

The mobile cleaning robot 300 can include a body 302 and a suspension system 335 including a drive arm 338 connected to the body at an arm pivot 339. The drive arm 338 can be movable or rotatable with respect to the body 302 about the arm pivot 339. The drive arm 338 can also be connected to a drive wheel 310 such as to support the drive wheel 310. The drive wheel 310 engage the floor surface 50 to help move the 300 about the environment 40. Optionally, the suspension system can include a 4-bar linkage connected to the body 302.

The mobile cleaning robot 300 can also include a container or tank 320 connectable to the body 302. For example, the tank 320 can be locatable or positionable within the 302. The tank 320 can optionally be removable from the body 302 of the mobile cleaning robot 300. The tank 320 can be configured to carry a fluid f therein such as for dispensing by a sprayer or nozzle (e.g., nozzle 116), as discussed above. The tank 320 can be any container or tank configured to receive and retain a fluid therein. In other examples the tank or container 320 can be configured to receive dry debris therein.

The suspension system 335 can also include a biasing element 340 connected to the drive arm 338 and connected to a link 336. The biasing element 340 can be any biasing element such as an extension spring, compression spring, spring bar, torsion spring, or the like. The biasing element 340 can be connected to a pivot 342 to connect the biasing element 340 to the drive arm 338 to bias the drive wheel 310 toward the floor surface 50. The biasing element 340 can also be connected to a pivot 344 to connect the biasing element 340 to the link 336 such as to allow rotation of the biasing element 340 with respect to the drive arm 338 and the link 336.

The suspension system 335 can also include the link 336 that can be movably (such as one or more of pivotably, rotatably, or slidingly) connected to the body 302 at pivot 346. The link 336 can include a projection 348, which can be a boss, protrusion, connector, slider, or other feature. The projection 348 can be engaged with a guide 350 of the tank 320 such that the 348 and the guide 350 can form a sliding linkage or rotating mechanism to allow movement of the tank to cause movement of the link 336, as discussed in further detail below. Though only one link 336 is shown, the mobile cleaning robot 300 can include two (as shown in FIG. 2C) or more links, such as 3, 4, 5, 6, 7, 8, 9, 10, or the like. The link 336 can be engageable or engaged with the tank 320, such as through the projection 348 and the guide 350 to adjust the biasing element 340 based on an amount of the fluid f in the tank 320. The link can be L-shaped, as shown in FIGS. 3A and 3B to accommodate three connection points, but can have other shapes in other examples, such as an X-shape, a C-shape, a T-shape, an S-shape, an irregular shape, or the like.

In operation of some examples, the tank 320 can be filled with fluid f such that tank 320 is full or nearly full as shown in FIG. 3A. In such a condition, the weight or mass of the fluid f can apply a force to the tank 320 which can apply a force to the projection 348 via the guide 350. This can cause the link 336 to move towards a rear of the robot or to be in its most downward position, causing movement of the pivot 344. This movement can cause the biasing element 340 to extend to a length L1 to increase the downforce F1 applied by the drive wheel 310 to the floor surface 50. That is, movement of the biasing element 340 due to the mass of the fluid f can change a downforce delivered to the drive wheel 310. Though the link 336 is discussed as moving rearward when the tank 320 is full, the link 336 can be configured to move in any direction.

As the fluid f is used or dispensed by the mobile cleaning robot 300, such as for cleaning or mopping operations (as discussed above), the fluid level f' can be reduced, as shown in FIG. 3B. This reduction in fluid level f' can reduce a weight or mass of the fluid within the tank 320 allowing upward movement of the 320 (caused by the biasing element 340), such that the distance D1 (shown in FIG. 3A) between the tank 320 and the body 302 is reduced to distance D2 (shown in FIG. 3B). This movement of the tank 320 within and relative to the body 302 can cause movement of the projection 348. Movement of the projection 348 within and with the guide 350 can cause movement or rotation of the link 336 about the pivot 346, such as to allow the link 336 to move to the position 336' shown in FIG. 3B. This movement causes the pivot 344 to move closer to the pivot 342, reducing a length of the biasing element 340 to L2, which can be shorter than the length L1. Because the biasing element 340 can be an extension spring (or a similar biasing element where length impacts exerted force), the shorter length L2 can cause a smaller force to be applied to the pivot 342 by the biasing element 340. This, in turn, can cause the downforce F2 to be smaller than the downforce F1, which helps to compensate for the reduction in weight of the tank 320 caused by the reduction in fluid level f in the tank 320.

In this way, the suspension system 335 of the mobile cleaning robot 300 can help to passively change the downforce provided by the drive wheel 310 to the floor surface 50 based on the amount of fluid f (or weight of the fluid f) within the tank 320, which can help to improve mobility of the robot throughout an environment and can help to improve cleaning efficiency of the mobile cleaning robot 300 and effectiveness over a course of a mission.

Though the suspension 335 is discussed as operating with a tank for storing fluids for mopping, the suspension can also be implemented with a dry tank (such as for vacuuming) or a wet and dry tank. In either instance, the suspension 335 can adjust the downforce of the wheel to be increased as the weight of the bin increases due to accumulation of debris therein.

Figure 4:
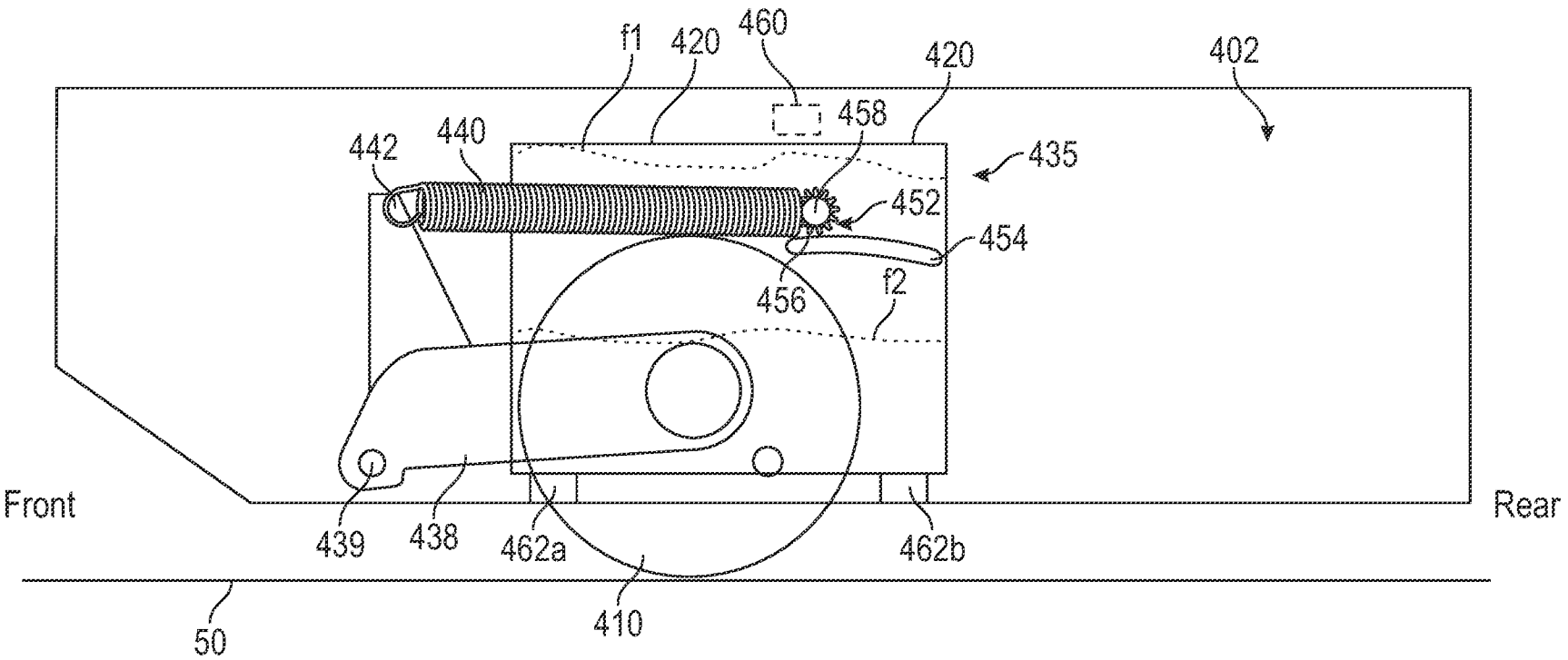
FIG. 4 illustrates a cross-section view of a mobile cleaning robot.

FIG. 4 illustrates a cross-section view of a mobile cleaning robot 400. The mobile cleaning robot 400 can be similar to the robot 100 and the mobile cleaning robot 300 discussed above; the mobile cleaning robot 400 can differ in that its suspension system can provide active control of a length of the biasing element to adjust downforce of the drive wheel. Any of the robots discussed above or below can be modified to include such components.

The mobile cleaning robot 400 can include a body 402 and a suspension system 435 including a drive arm 438 connected to the body at an arm pivot 439. The drive arm 438 can be movable or rotatable with respect to the body 402 about the arm pivot 439. The drive arm 438 can also be connected to a drive wheel 410 such as to support the drive wheel 410. The drive wheel 410 can be engaged with the floor surface 50 to move the 400 about the environment 40.

The mobile cleaning robot 400 can also include a container or tank 420 connectable to the body 402. For example, the tank 420 can be locatable or positionable within the 402. The tank 420 can optionally be removable from the body 402 of the mobile cleaning robot 400. The tank 420 can be configured to carry a fluid f therein such as for dispensing by a sprayer or nozzle (e.g., nozzle 116), as discussed above.

The suspension system 435 can also include a biasing element 440 connected to the drive arm 438. The biasing element 440 can be any biasing element such as an extension spring, compression spring, spring bar, torsion spring, or the like. The biasing element 440 can be connected to a pivot 442 to apply a force on the pivot 442 to bias the drive wheel 410 toward the floor surface 50.

The suspension system 435 can also include a drive system 452 including a rack 454, a pinion 456, and a bearing 458. The rack 454 can be a geared rack such as a straight rack or a curved rack including teeth, which can be engageable or engaged with the pinion 456. The pinion 456 can be connected to an actuator or motor 460, which can be in communication with a controller (e.g., 112). The motor 460 can be operable to rotate the pinion 456. The bearing 458 can be connected to the pinion 456 and movable therewith. The bearing 458 can be connected to the biasing element 440 such that the biasing element 440 can be movable with the pinion 456 and the bearing 458.

The mobile cleaning robot 400 can also include sensors 462*a* and 462*b* (sensors 462) connected to the body 402 and engaged with the tank 420. One or more of the sensors 462 can be configured to produce a signal based on a weight or mass of the tank 420, and can be configured transmit the signal to the controller. One or more of the sensors 462 can be a single point load cell, a digital load cell, a beam load cell, a canister load cell, a hydraulic load cell, a strain gauge, a capacitive load cell, a piezoelectric transducer, or the like. Optionally, the sensors 462 can be one or more break beam sensors that can trigger and un-trigger to have two setpoints. In some examples, fluid levels can be determined through fluid level measurements (such as using capacitive, resistive, or magnetic level sensors). Level sensors can be used, such as by a controller to determine a load of the tank.

In operation of some examples, the tank 420 can be filled with fluid f to the level f1, such that the tank 420 is full or relatively full, such as at the beginning of a cleaning or mopping mission. The sensors 462 can measure the weight or mass of the tank 420 (or can sense the fluid as it is dispensed) and the fluid f therein and can transmit a signal to the controller based on the sensed or detected mass or load. The controller can determine a mass of the tank based on the load signal and can instruct or operate the motor 460 to operate the pinion 456 to rotate to move along the rack 454. For example, when the controller determines that the fluid level is full or the load is high, the controller can operate the motor 460 to drive the pinion 456 to a far rear portion of the rack 454, which can move or extend the biasing element 440 to its maximum length, increasing a force applied by the biasing element 440 to the drive arm 438 increasing a downforce applied to the floor surface 50 by the drive wheel 410.

As the fluid f is used by the mobile cleaning robot 400, the fluid level can decrease, decreasing the mass or weight of the tank 420. The change can be sensed by the sensors 462 which can alter the load signal(s) transmitted to the controller by the sensors 462. The controller can then determine that the weight has lowered (or changed) and can therefore determine that the downforce required to be delivered by the drive wheel 410 is relatively lower. The controller can then operate the motor 460 to drive the pinion 456 to rotate to move the pinion 456 along the rack 454, such as toward the front of the body 402 to reduce a length of the biasing element 440. The reduction of length of the biasing element 440 can decrease a force applied to the drive arm 438, decreasing the downforce applied by the drive wheel 410 to the floor surface 50.

In this way, the suspension system 435 of the mobile cleaning robot 400 can be actively controlled by a controller of the mobile cleaning robot 400 to adjust the downforce provided by the drive wheel 410 based on the fluid level within the tank 420. This active control of the downforce can help to improve mobility of the robot throughout an environment and can help to improve cleaning efficiency and effectiveness of the mobile cleaning robot 400 over a course of a mission.

Network Examples

Figure 5:
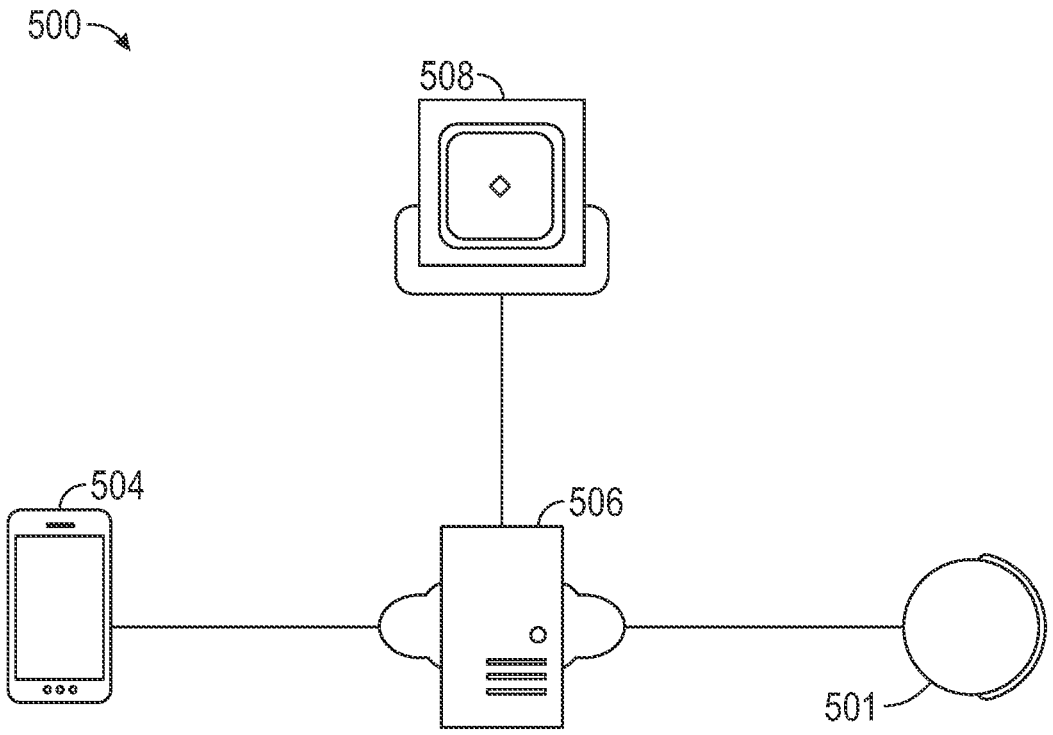
FIG. 5 illustrates a schematic of a mobile cleaning robot network.

FIG. 5 is a diagram illustrating an example of a communication network 500 that can enable networking between the mobile robot 501 and one or more other devices, such as a mobile device 504, a cloud computing system 506, or another autonomous robot 508 separate from the mobile robot 501. Though the network below is discussed as the robot 501 being a primary robot, the robot 508 can be the primary robot.

Using the communication network 510, the robot 501, the mobile device 504, the robot 508, and the cloud computing system 506 can communicate with one another to transmit and receive data from one another. In some examples, the robot 501, the robot 508, or both the robot 501 and the robot 508 communicate with the mobile device 504 through the cloud computing system 506. Alternatively, or additionally, the robot 501, the robot 508, or both the robot 501 and the robot 508 communicate directly with the mobile device 504. Various types and combinations of wireless networks (e.g., Bluetooth, radio frequency, optical based, etc.) and network architectures (e.g., mesh networks) can be employed by the communication network 510.

In some examples, the mobile device 504 can be a remote device that can be linked to the cloud computing system 506 and can enable a user to provide inputs. The mobile device 504 can include user input elements such as, for example, one or more of a touchscreen display, buttons, a microphone, a mouse, a keyboard, or other devices that respond to inputs provided by the user. The mobile device 504 can also include immersive media (e.g., virtual reality) with which the user can interact to provide input. The mobile device 504, in these examples, can be a virtual reality headset or a head-mounted display.

The user can provide inputs corresponding to commands for the mobile robot 501. In such cases, the mobile device 504 can transmit a signal to the cloud computing system 506 to cause the cloud computing system 506 to transmit a command signal to the mobile robot 501. In some implementations, the mobile device 504 can present augmented reality images. In some implementations, the mobile device 504 can be a smart phone, a laptop computer, a tablet computing device, or other mobile device.

According to some examples discussed herein, the mobile device 504 can include a user interface configured to display a map of the robot environment. A robot path, such as that identified by a coverage planner, can also be displayed on the map. The interface can receive a user instruction to modify the environment map, such as by adding, removing, or otherwise modifying a keep-out zone in the environment; adding, removing, or otherwise modifying a focused cleaning zone in the environment (such as an area that requires repeated cleaning); restricting a robot traversal direction or traversal pattern in a portion of the environment; or adding or changing a cleaning rank, among others.

In some examples, the communication network 510 can include additional nodes. For example, nodes of the communication network 510 can include additional robots. Also, nodes of the communication network 510 can include network-connected devices that can generate information about the environment 40. Such a network-connected device can include one or more sensors, such as an acoustic sensor, an image capture system, or other sensor generating signals, to detect characteristics of the environment 40 from which features can be extracted. Network-connected devices can also include home cameras, smart sensors, or the like.

In the communication network 510, the wireless links can utilize various communication schemes, protocols, etc., such as, for example, Bluetooth classes, Wi-Fi, Bluetooth-low-energy, also known as BLE, 802.15.4, Worldwide Interoperability for Microwave Access (WiMAX), an infrared channel, satellite band, or the like. In some examples, wireless links can include any cellular network standards used to communicate among mobile devices, including, but not limited to, standards that qualify as 1G, 2G, 3G, 4G, 5G, or the like. The network standards, if utilized, qualify as, for example, one or more generations of mobile telecommunication standards by fulfilling a specification or standards such as the specifications maintained by International Telecommunication Union. For example, the 4G standards can correspond to the International Mobile Telecommunications Advanced (IMT-Advanced) specification. Examples of cellular network standards include AMPS, GSM, GPRS, UMTS, LTE, LTE Advanced, Mobile WiMAX, and WiMAX-Advanced. Cellular network standards can use various channel access methods, e.g., FDMA, TDMA, CDMA, or SDMA.

Figure 6:
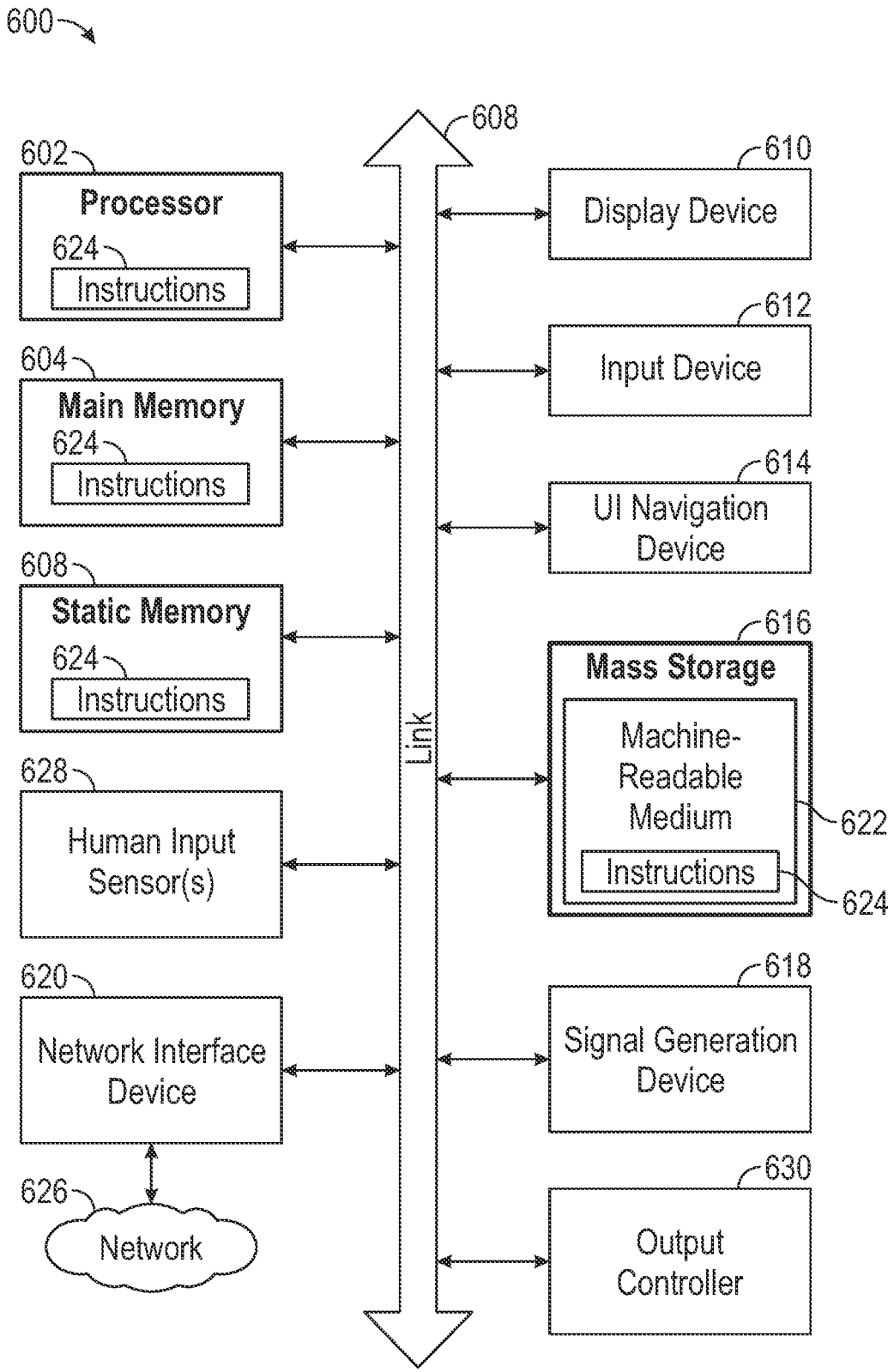
FIG. 6 illustrates a schematic of a system.

FIG. 6 illustrates a block diagram of an example machine 600 upon which any one or more of the techniques (e.g., methodologies) discussed herein may perform. Examples, as described herein, may include, or may operate by, logic or a number of components, or mechanisms in the machine 600. Circuitry (e.g., processing circuitry) is a collection of circuits implemented in tangible entities of the machine 600 that include hardware (e.g., simple circuits, gates, logic, etc.). Circuitry membership may be flexible over time. Circuitries include members that may, alone or in combination, perform specified operations when operating. In an example, hardware of the circuitry may be immutably designed to carry out a specific operation (e.g., hardwired). In an example, the hardware of the circuitry may include variably connected physical components (e.g., execution units, transistors, simple circuits, etc.) including a machine readable medium physically modified (e.g., magnetically, electrically, moveable placement of invariant massed particles, etc.) to encode instructions of the specific operation. In connecting the physical components, the underlying electrical properties of a hardware constituent are changed, for example, from an insulator to a conductor or vice versa. The instructions enable embedded hardware (e.g., the execution units or a loading mechanism) to create members of the circuitry in hardware via the variable connections to carry out portions of the specific operation when in operation. Accordingly, in an example, the machine readable medium elements are part of the circuitry or are communicatively coupled to the other components of the circuitry when the device is operating. In an example, any of the physical components may be used in more than one member of more than one circuitry. For example, under operation, execution units may be used in a first circuit of a first circuitry at one point in time and reused by a second circuit in the first circuitry, or by a third circuit in a second circuitry at a different time. Additional examples of these components with respect to the machine 600 follow.

In alternative embodiments, the machine 600 may operate as a standalone device or may be connected (e.g., networked) to other machines. In a networked deployment, the machine 600 may operate in the capacity of a server machine, a client machine, or both in server-client network environments. In an example, the machine 600 may act as a peer machine in peer-to-peer (P2P) (or other distributed) network environment. The machine 600 may be a personal computer (PC), a tablet PC, a set-top box (STB), a personal digital assistant (PDA), a mobile telephone, a web appliance, a network router, switch or bridge, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein, such as cloud computing, software as a service (SaaS), other computer cluster configurations.

The machine (e.g., computer system) 600 may include a hardware processor 602 (e.g., a central processing unit (CPU), a graphics processing unit (GPU), a hardware processor core, or any combination thereof), a main memory 604, a static memory (e.g., memory or storage for firmware, microcode, a basic-input-output (BIOS), unified extensible firmware interface (UEFI), etc.) 606, and mass storage 608 (e.g., hard drive, tape drive, flash storage, or other block devices) some or all of which may communicate with each other via an interlink (e.g., bus) 630. The machine 600 may further include a display unit 610, an alphanumeric input device 612 (e.g., a keyboard), and a user interface (UI) navigation device 614 (e.g., a mouse). In an example, the display unit 610, input device 612 and UI navigation device 614 may be a touch screen display. The machine 600 may additionally include a storage device (e.g., drive unit) 608, a signal generation device 618 (e.g., a speaker), a network interface device 620, and one or more sensors 616, such as a global positioning system (GPS) sensor, compass, accelerometer, or other sensor. The machine 600 may include an output controller 628, such as a serial (e.g., universal serial bus (USB), parallel, or other wired or wireless (e.g., infrared (IR), near field communication (NFC), etc.) connection to communicate or control one or more peripheral devices (e.g., a printer, card reader, etc.).

Registers of the processor 602, the main memory 604, the static memory 606, or the mass storage 608 may be, or include, a machine readable medium 622 on which is stored one or more sets of data structures or instructions 624 (e.g., software) embodying or utilized by any one or more of the techniques or functions described herein. The instructions 624 may also reside, completely or at least partially, within any of registers of the processor 602, the main memory 604, the static memory 606, or the mass storage 608 during execution thereof by the machine 600. In an example, one or any combination of the hardware processor 602, the main memory 604, the static memory 606, or the mass storage 608 may constitute the machine readable media 622. While the machine readable medium 622 is illustrated as a single medium, the term "machine readable medium" may include a single medium or multiple media (e.g., a centralized or distributed database, and/or associated caches and servers) configured to store the one or more instructions 624.

The term "machine readable medium" may include any medium that is capable of storing, encoding, or carrying instructions for execution by the machine 600 and that cause the machine 600 to perform any one or more of the techniques of the present disclosure, or that is capable of storing, encoding or carrying data structures used by or associated with such instructions. Non-limiting machine readable medium examples may include solid-state memories, optical media, magnetic media, and signals (e.g., radio frequency signals, other photon based signals, sound signals, etc.). In an example, a non-transitory machine readable medium comprises a machine readable medium with a plurality of particles having invariant (e.g., rest) mass, and thus are compositions of matter. Accordingly, non-transitory machine-readable media are machine readable media that do not include transitory propagating signals. Specific examples of non-transitory machine readable media may include: non-volatile memory, such as semiconductor memory devices (e.g., Electrically Programmable Read-Only Memory (EPROM), Electrically Erasable Programmable Read-Only Memory (EEPROM)) and flash memory devices; magnetic disks, such as internal hard disks and removable disks; magneto-optical disks; and CD-ROM and DVD-ROM disks.

The instructions 624 may be further transmitted or received over a communications network 626 using a transmission medium via the network interface device 620 utilizing any one of a number of transfer protocols (e.g., frame relay, internet protocol (IP), transmission control protocol (TCP), user datagram protocol (UDP), hypertext transfer protocol (HTTP), etc.). Example communication networks may include a local area network (LAN), a wide area network (WAN), a packet data network (e.g., the Internet), mobile telephone networks (e.g., cellular networks), Plain Old Telephone (POTS) networks, and wireless data networks (e.g., Institute of Electrical and Electronics Engineers (IEEE) 802.11 family of standards known as Wi-Fi®, IEEE 802.16 family of standards known as WiMax®), IEEE 802.15.4 family of standards, peer-to-peer (P2P) networks, among others. In an example, the network interface device 620 may include one or more physical jacks (e.g., Ethernet, coaxial, or phone jacks) or one or more antennas to connect to the communications network 626. In an example, the network interface device 620 may include a plurality of antennas to wirelessly communicate using at least one of single-input multiple-output (SIMO), multiple-input multiple-output (MIMO), or multiple-input single-output (MISO) techniques. The term "transmission medium" shall be taken to include any intangible medium that is capable of storing, encoding or carrying instructions for execution by the machine 600, and includes digital or analog communications signals or other intangible medium to facilitate communication of such software. A transmission medium is a machine readable medium.

NOTES AND EXAMPLES

The following, non-limiting examples, detail certain aspects of the present subject matter to solve the challenges and provide the benefits discussed herein, among others.

Example 1 is a mobile cleaning robot movable within an environment, the mobile cleaning robot comprising: a body; a drive arm connected to the body and movable with respect to the body, the drive arm supporting a drive wheel; a container connectable to the body and configured to carry a fluid therein; a biasing element connected to the drive arm to bias the drive wheel toward a floor surface; and a link pivotably connected to the body and connected to the biasing element, the link engageable with the container to adjust the biasing element based on an amount of the fluid in the tank.

In Example 2, the subject matter of Example 1 optionally includes wherein movement of the biasing element changes a downforce delivered to the drive wheel.

In Example 3, the subject matter of Example 2 optionally includes wherein the link is connected to the tank through at least one of a sliding and pivoting engagement.

In Example 4, the subject matter of Example 3 optionally includes wherein the link is connected to a first lateral side of the tank.

In Example 5, the subject matter of Example 4 optionally includes a second link connected to a second lateral side of the tank, opposite the link and the first lateral side of the tank; and a second biasing element connected to a second drive arm to bias a second drive wheel connected to the second drive arm toward the floor surface.

In Example 6, the subject matter of any one or more of Examples 1-5 optionally include wherein the biasing element includes an extension spring.

In Example 7, the subject matter of any one or more of Examples 1-6 optionally include wherein the tank is configured to move vertically based on an amount of fluid within the tank.

In Example 8, the subject matter of Example 7 optionally includes wherein vertical movement of the tank causes the link to at least one of slide or rotate with respect to the body.

Example 9 is a mobile cleaning robot movable within an environment, the mobile cleaning robot comprising: a body; a drive wheel arm connected to the body and movable with respect to the body, the drive wheel arm supporting a drive wheel; tank connectable to the body and configured to receive and retain a fluid therein; a biasing element connected to the drive arm to bias the drive wheel toward a floor surface; and an actuator connected to the body and the biasing element: a transducer connected to the tank and configured to produce a load signal based on an amount of the fluid within the tank; and a controller configured to: determine a mass of the tank based on the load signal; and operate the actuator based on the determined mass to adjust the biasing element.

In Example 10, the subject matter of Example 9 optionally includes wherein the actuator includes a rack connected to the body and the actuator includes a pinion engaged with the rack, the pinion connected to the biasing element and drivable to move the pinion along the rack to adjust a length of the biasing element.

In Example 11, the subject matter of any one or more of Examples 9-10 optionally include wherein movement of the biasing element changes a downforce delivered to by the drive wheel.

In Example 12, the subject matter of Example 11 optionally includes wherein the actuator is connected to a first lateral side of the tank.

In Example 13, the subject matter of Example 12 optionally includes a second actuator connected to a second lateral side of the tank, opposite the actuator and the first lateral side of the tank.

In Example 14, the subject matter of any one or more of Examples 9-13 optionally include wherein the biasing element includes an extension spring and the transducer includes a load cell.

Example 15 is a mobile cleaning robot movable within an environment, the mobile cleaning robot comprising: a body; a drive wheel connected to the body and engageable with a floor surface; a container connectable to the body and configured to receive and retain a mass therein; a biasing element connected to the drive wheel to bias the drive wheel toward a floor surface; and a link connected to the body and the biasing element, the link engageable with the container to adjust a force applied by the drive wheel based on a mass carried in the container.

In Example 16, the subject matter of Example 15 optionally includes wherein movement of the biasing element changes a downforce delivered to the drive wheel.

In Example 17, the subject matter of Example 16 optionally includes wherein the link is connected to the container through at least one of a sliding and pivoting engagement.

In Example 18, the subject matter of Example 17 optionally includes wherein the link is located on a first lateral side of the tank.

In Example 19, the subject matter of Example 18 optionally includes a second link located on a second lateral side of the tank, opposite the link and the first lateral side of the tank; and a second biasing element connected to a second drive arm to bias a second drive wheel connected to the second drive arm toward the floor surface.

In Example 20, the subject matter of any one or more of Examples 15-19 optionally include wherein the tank is configured to move vertically based on an amount of fluid within the container.

In Example 21, the apparatuses or method of any one or any combination of Examples 1-20 can optionally be configured such that all elements or options recited are available to use or select from.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A mobile cleaning robot movable within an environment, the mobile cleaning robot comprising:

a body;

a drive arm connected to the body and movable with respect to the body, the drive arm supporting a drive wheel;

a tank connectable to the body and configured to carry a fluid therein;

a biasing element connected to the drive arm to bias the drive wheel toward a floor surface; and a link pivotably connected to the body and connected to the biasing element, the link engageable with the tank to adjust the biasing element based on an amount of the fluid in the tank.

2. The mobile cleaning robot of claim 1, wherein movement of the biasing element changes a downforce delivered to the drive wheel.

3. The mobile cleaning robot of claim 2, wherein the link is connected to the tank through at least one of a sliding and pivoting engagement.

4. The mobile cleaning robot of claim 3, wherein the link is connected to a first lateral side of the tank.

5. The mobile cleaning robot of claim 4, further comprising:

a second link connected to a second lateral side of the tank, opposite the link and the first lateral side of the tank; and a second biasing element connected to a second drive arm to bias a second drive wheel connected to the second drive arm toward the floor surface.

6. The mobile cleaning robot of claim 1, wherein the biasing element includes an extension spring.

7. The mobile cleaning robot of claim 1, wherein the tank is configured to move vertically based on an amount of fluid within the tank.

8. The mobile cleaning robot of claim 7, wherein vertical movement of the tank causes the link to at least one of slide or rotate with respect to the body.

9. A mobile cleaning robot movable within an environment, the mobile cleaning robot comprising:

a body;

a drive wheel arm connected to the body and movable with respect to the body, the drive wheel arm supporting a drive wheel;

a tank connectable to the body and configured to receive and retain a fluid therein;

a biasing element connected to the drive arm to bias the drive wheel toward a floor surface;

an actuator connected to the body and the biasing element;

a sensor connected to the tank and configured to produce a load signal based on an amount of the fluid within the tank; and a controller configured to:

determine a mass of the tank based on the load signal; and operate the actuator based on the determined mass to adjust the biasing element.

10. The mobile cleaning robot of claim 9, wherein the actuator includes a rack connected to the body and the actuator includes a pinion engaged with the rack, the pinion connected to the biasing element and drivable to move the pinion along the rack to adjust a length of the biasing element.

11. The mobile cleaning robot of claim 9, wherein movement of the biasing element changes a downforce delivered to by the drive wheel.

12. The mobile cleaning robot of claim 11, wherein the actuator is connected to a first lateral side of the tank.

13. The mobile cleaning robot of claim 12, further comprising:

a second actuator connected to a second lateral side of the tank, opposite the actuator and the first lateral side of the tank.

14. The mobile cleaning robot of claim 9, wherein the biasing element includes an extension spring and the sensor includes a load cell.

15. A mobile cleaning robot movable within an environment, the mobile cleaning robot comprising:

a body;

a drive wheel connected to the body and engageable with a floor surface;

a container connectable to the body and configured to receive and retain a mass therein;

a biasing element connected to the drive wheel to bias the drive wheel toward a floor surface; and a link connected to the body and the biasing element, the link engageable with the container to adjust a force applied by the drive wheel based on a mass carried in the container.

16. The mobile cleaning robot of claim 15, wherein movement of the biasing element changes a downforce delivered to the drive wheel.

17. The mobile cleaning robot of claim 16, wherein the link is connected to the container through at least one of a sliding and pivoting engagement.

18. The mobile cleaning robot of claim 17, wherein the link is located on a first lateral side of the container.

19. The mobile cleaning robot of claim 18, further comprising:

a second link located on a second lateral side of the container, opposite the link and the first lateral side of the container; and a second biasing element connected to a second drive arm to bias a second drive wheel connected to the second drive arm toward the floor surface.

20. The mobile cleaning robot of claim 15, wherein the container is configured to move vertically based on an amount of fluid within the container.

* * * * *